US005729927A

United States Patent [19]

Shaver, Jr.

[11] Patent Number: 5,729,927

[45] Date of Patent: Mar. 24, 1998

[54] FIREARM ADAPTER DEVICE AND CARTRIDGE CARRIER FOR USE THEREIN

[76] Inventor: Gerald Lee Shaver, Jr., 559 NW. 7th Rd., Iantha, Mo. 64759

[21] Appl. No.: 620,403

[22] Filed: Mar. 22, 1996

[51] Int. Cl.[6] ..... F41A 21/14

[52] U.S. Cl. ..... 42/77

[58] Field of Search ..... 42/77; 89/29; 102/446

[56] References Cited

U.S. PATENT DOCUMENTS

| | | | |
|---|---|---|---|
| 741,079 | 10/1903 | Tasker | 89/29 |
| 745,464 | 12/1903 | Tasker | 89/29 |
| 834,341 | 10/1906 | Tucker | 102/446 |
| 1,126,294 | 1/1915 | Saffold | 42/77 |
| 1,239,287 | 9/1917 | Masterton | 42/77 |
| 1,538,561 | 5/1925 | Koller | 102/446 |
| 2,059,658 | 11/1936 | Sandine | 42/77 |
| 2,423,471 | 7/1947 | Summerbell | 89/29 |
| 3,138,889 | 6/1964 | Groover | 42/77 |
| 3,156,995 | 11/1964 | Mellor et al. | 42/77 |
| 3,339,304 | 9/1967 | Knode, Jr. et al. | 42/77 |
| 3,384,989 | 5/1968 | Thomas | 42/77 |
| 3,598,053 | 8/1971 | Glater | 102/446 |
| 3,805,434 | 4/1974 | Sudano | 42/77 |
| 4,620,485 | 11/1986 | Bertiller | 102/444 |
| 4,633,755 | 1/1987 | Bertiller et al. | 89/29 |
| 4,702,170 | 10/1987 | Trudeau | 102/446 |
| 4,735,009 | 4/1988 | Jett, Jr. | 42/77 |
| 4,955,157 | 9/1990 | Brighton et al. | 42/77 |

OTHER PUBLICATIONS

"Ordnance Notes No. 349, Gallery Firing the 45–70 Trapdoor Springfield Using Reduced Loads Or .22 Calibre Ammunition", *The Single Shot Exchange*, (Nov. 1995), pp. 4–5.

*Primary Examiner*—Michael J. Carone
*Assistant Examiner*—Matthew J. Lattig
*Attorney, Agent, or Firm*—William R. Sharp

[57] ABSTRACT

An adapter device for a breech-loading firearm employs a cartridge carrier which holds a cartridge by its rim. The cartridge carrier holds the cartridge such that its rear face contacts a forward face of the cartridge carrier. The adapter device further comprises an adapter barrel, sized to be received within the barrel of the firearm (primary barrel), and spacer rings for supporting the adapter barrel within the primary barrel. The adapter barrel has an adapter breech for abutting a forward end of the cartridge carrier so that the cartridge extends into the adapter barrel.

18 Claims, 3 Drawing Sheets

FIREARM ADAPTER DEVICE AND CARTRIDGE CARRIER FOR USE THEREIN

BACKGROUND OF THE INVENTION

This invention relates to an adapter device for use in a firearm. According to a more particular aspect, the invention also relates to a cartridge carrier that can be used as a component of the adapter device.

Large caliber rifles, such as 0.40 and 0.45 caliber breech-loading single shot rifles, were widely used in the 19th century for the hunting of big game, buffalo in particular. In the latter part of the 20th century these firearms have again become popular. Now, however, such large caliber rifles are being used primarily for competitive target shooting. To prepare for competition, or simply to improve one's skills, it is frequently desirable to do a great deal of practice shooting. Such practice shooting presents a number of problems. For example, shooting the large caliber cartridges cannot normally be done at indoor practice ranges. Long periods of practice can also cause considerable fatigue due to the strong recoil of the rifle. In addition, the large caliber cartridges are expensive, and must normally be reloaded by hand in a time consuming procedure.

Accordingly, it would be desirable to employ an adapter device in large caliber rifles in order to allow practice shooting with smaller caliber (i.e. 0.22 caliber) cartridges. Such an adapter device would enable practice shooting at indoor practice ranges, minimize fatigue, and save time and money.

Adapter devices, sometimes called subcaliber devices, are known for use in rifles. Heretofore, however, prior adapter devices have had one or more of the following problems: an unacceptable level of accuracy; in devices having a cartridge carrier with a firing pin, the difficult and inconvenient requirement of removing the firing pin in order to remove a fired cartridge or insert a new cartridge; the lack of adaptability to accommodate different calibers or chamber lengths; and combustion gas leakage to the rear, presenting a potential hazard to the shooter.

SUMMARY OF THE INVENTION

It is, therefore, an object of the invention to provide a firearm adapter device which is highly accurate.

It is also an object of the invention that the adapter device has a cartridge carrier with a firing pin which does not require removal of the firing pin in order to remove a fired cartridge or insert a new cartridge.

It is a further object of the invention that the adapter device is adaptable to different calibers and chamber lengths.

It is yet another object of the invention that the adapter device effectively prevents leakage of combustion gas to the rear.

There is provided by the invention an adapter device for use in a firearm to fire a cartridge having a rim and a substantially coextensive rear face, wherein the firearm is of the breech-loading type including a primary barrel, a primary breech, a primary muzzle, and a primary bore and primary chamber defined therein such that the primary bore extends from the primary muzzle to the primary chamber and the primary chamber extends to the primary breech, the firearm further including a primary firing pin to the rear of the primary breech, wherein the adapter device comprises: an adapter barrel having an adapter breech, an adapter muzzle, and an adapter bore and adapter chamber defined therein such that the adapter bore extends from the adapter muzzle to the adapter chamber and the adapter chamber extends to the adapter breech, wherein the adapter barrel is sized for being received within the primary barrel; a spacer means, fixedly secured to the adapter barrel, for being disposed in the primary barrel to support the adapter barrel within the primary barrel in substantially coaxial relationship therewith, and such that the adapter barrel extends through at least a portion of the primary barrel from the adapter breech, closely adjacent to or within the primary chamber, to the adapter muzzle; and a cartridge carrier sized and shaped to fit within the primary chamber and having (i) a forward carrier end defining a forward carrier face and being adapted to removably hold the cartridge by its rim so that the rear face of the cartridge contacts the forward carrier face, the forward carrier end being further adapted to abut the adapter breech in such a manner that the cartridge extends into the adapter chamber, (ii) a rear carrier end for being positioned at or closely adjacent to the primary breech, (iii) a carrier body extending between the forward and rear carrier ends and having a passageway longitudinally extending therethrough between the forward and rear carrier ends, the passageway having a forward open end at the forward carrier end and a rear open end at the rear carrier end, and (iv) an adapter firing pin extending through the passageway and having a forward pin end at or closely adjacent to the forward open end and a rear pin end at or closely adjacent to the rear open end, the adapter firing pin being mounted within the passageway so as to be longitudinally movable in a substantially forward direction in response to striking of the rear pin end by the primary firing pin, whereby the rim or rear face of the cartridge as held by the forward carrier end is struck by the forward pin end.

According to another aspect of the invention, there is provided a cartridge carrier for use in a firearm with a cartridge having a rim and a substantially coextensive face, comprising: a first carrier end defining a carrier face and being adapted to removably hold the cartridge by its rim so that the face of the cartridge contacts the carrier face; a second carrier end opposite the first carrier end; a carrier body extending between the first and second carrier ends and having a passageway longitudinally extending therethrough between the first and second carrier ends, the passageway having a first open end at the first carrier end and a second open end at the second carrier end; a firing pin extending through the passageway and having a first pin end at or closely adjacent to the first open end and a second pin end at or closely adjacent to the second open end, the firing pin being mounted within the passageway so as to be longitudinally movable in a direction substantially toward the first carrier end in response to an impact upon the second pin end, whereby the rim or face of the cartridge as held by the first carrier end is struck by the first pin end.

Accuracy of the adapter device is optimized by two unique features. First, the cartridge, as held by the cartridge carrier in the adapter device, extends into and is received by the adapter chamber of the adapter barrel. This overcomes the problems inherent in some prior adapter devices in which the cartridge carrier receives the cartridge in a passageway that could be misaligned with the bore of the adapter barrel. Such misalignment can cause distortion of a bullet which is fired from the cartridge and consequent inaccurate flight. Second, a cartridge held by the cartridge carrier in the adapter device has its rear face in contact with the forward carrier face. Such contact, particularly when the rear face of the cartridge is substantially flush with the forward carrier face, provides even and snug support for the rear face of the cartridge to further optimize accuracy, which is in contrast to some prior adapter devices that provide little or uneven support. The even and snug support of the rear face will help prevent the tendency of the cartridge to slide rearward in the chamber upon firing, and will also help prevent swelling of rear face upon firing. Any such movement and/or swelling at the time of firing will detrimentally affect accuracy.

Another advantage of the invention is that the adapter firing pin need not be removed from the cartridge carrier in order to remove a fired cartridge or insert a new cartridge. Since the cartridge is held only by its rim, instead of being received within a passageway in the cartridge carrier as in some prior adapter devices, the fired cartridge can be easily slipped out and a new cartridge slipped back into the cartridge carrier while leaving the adapter firing pin in place. This makes reloading the cartridge carrier easy, convenient, and fast.

According to preferred embodiments of the invention, the adapter device further comprises an adjustment nut threadedly received on the adapter barrel. The adjustment nut, which is sized and shaped to abut a forward shoulder of the primary chamber, allows adjustment of the adapter device for different primary chamber lengths. An adjustment nut of the proper diameter can be used for a firearm of a particular caliber.

Another preferred feature is the use of a plurality of spacer rings as the spacer means, where such spacer rings are comprised of a compressible and resilient foam material, most preferably polyurethane foam. The compressibility of the foam material allows for its use in different calibers, and its resiliency serves to position the adapter barrel in a substantially coaxial relationship with the primary barrel.

Finally, the adapter chamber will be sized to closely receive the cartridge such that, upon firing, instantaneous expansion of the cartridge will seal the adapter breech and therefore prevent the rearward escape of combustion gases.

DETAILED DESCRIPTION OF THE INVENTION

Preferred embodiments of the invention will now be described with reference to the FIGURES. The term "cartridge", as used in the following description as well as the Summary of the invention and appended claims, is broadly defined as a round of ammunition comprising a case in which a primer, powder, and at least one projectile are inserted.

Figure 1:
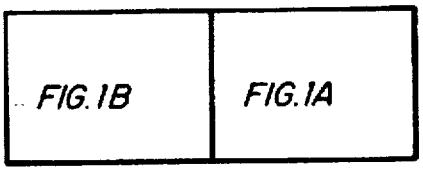
FIG. 1 indicates the manner in which the partial views of FIGS. 1A and 1B are linked together to form a complete, cross-sectional view of the barrel of a firearm (denoted herein as the primary barrel) having an adapter device contained therein.
Figure 1A:
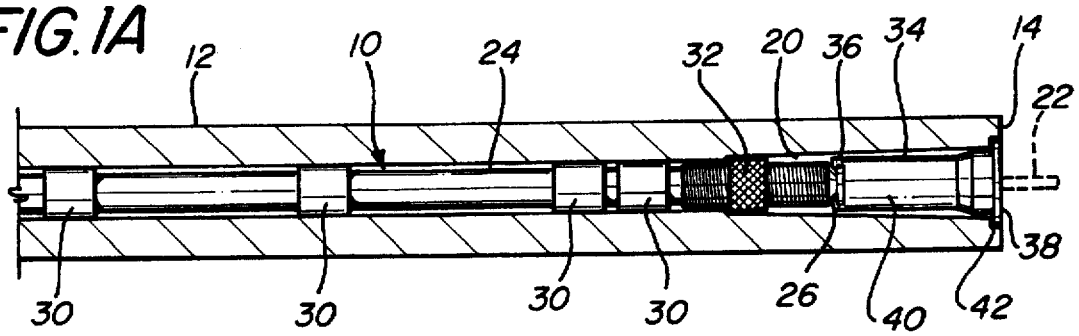
FIG. 1A shows a rear portion of the adapter device and FIG. 1B shows a forward portion of the adapter device.
Figure 1B:
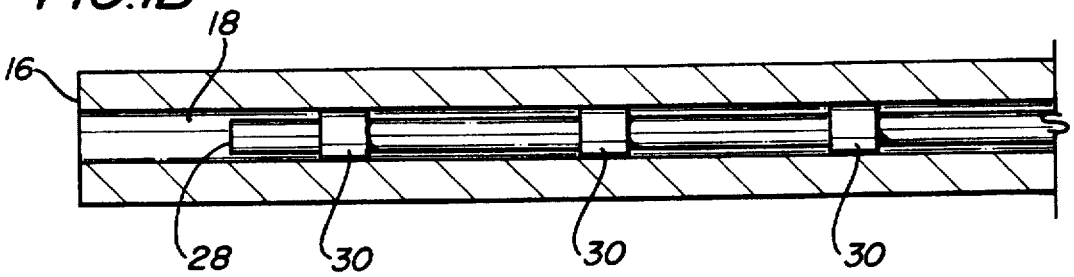

Referring to FIGS. 1A and 1B, the illustrated adapter device 10 is illustrated as being installed in primary barrel 12 of a breech-loading firearm. The firearm can be, for example, a rifle of a large caliber (i.e. 38 caliber or larger). Primary barrel 12 has a primary breech 14, a primary muzzle 16, and a primary bore 18 and primary chamber 20 defined therein such that primary bore 18 extends from primary muzzle 16 to primary chamber 20 and primary chamber 20 extends to primary breech 14. The firearm further includes a primary firing pin 22, which is shown schematically by broken lines in its approximate position upon firing to the rear of primary breech 14.

Adapter device 10 is illustrated as comprising: an adapter barrel 24, having an adapter breech 26 and an adapter muzzle 28, which is sized to be received within primary barrel 12; a plurality of spacer rings 30, fixedly secured to adapter barrel 24, which are disposed in primary barrel 12 to support adapter barrel 24 within the primary barrel in substantially coaxial relationship therewith, and such that adapter barrel 24 extends through at least a portion of primary barrel 12 from adapter breech 26, preferably within primary chamber 20, to adapter muzzle 28; an adjustment nut 32 threadedly received on adapter barrel 24 to allow adjustment of its position along a portion of adapter barrel 24, the adjustment nut being sized and shaped to abut a forward shoulder (more clearly shown in FIG. 2) of primary chamber 20 to thereby enable adjustment of the adapter device to fit the length of primary chamber 20; and a cartridge carrier 34 sized and shaped to fit within primary chamber 20 and having a forward carrier end 36 abutting adapter breech 26, a rear carrier end 38 preferably positioned at primary breech 14, and a carrier body 40 extending between forward carrier end 36 and rear carrier end 38. Rear carrier end 38 has a rim 42 that is capable of being engaged by a conventional extractor (not shown) of the firearm. Other conventional features associated with the breech action of the firearm are also not shown.

Seven spacer rings 30 are employed in the embodiment of FIGS. 1A and 1B. Two rings are positioned closely adjacent to primary chamber 20, and the remaining five rings are equidistantly spaced along adapter barrel 24. Of course, more or less spacer rings could be used, but it is preferable to have at least four spacer rings to provide the desired stability and support of adapter barrel 24 within primary barrel 12. The preferred material for each of spacer rings 30 is a resilient foam material, most preferably polyurethane foam. Such a material is sufficiently resilient to properly center adapter barrel 24 within primary barrel 12, and is also sufficiently compressible to allow insertion of spacer rings 30 into primary barrels of different calibers. This material also provides excellent dampening of vibration upon firing of the firearm, an important feature in optimizing accuracy. Vibration could, if desired, be dampened further by removably positioning a synthetic rubber O-ring (not shown) closely adjacent to and on the forward side of adjustment nut 32.

Adjustment nut 32 preferably has a knurled outer surface and is removable from adapter barrel 24. Upon removal of adapter device 10 from primary barrel 12, removability of adjustment nut 32 allows its replacement with a different size of adjustment nut to fit within a firearm of a different caliber. Removability of adjustment nut 32 also provides flexibility in the manner in which adapter device 10 is installed in primary barrel 12, as is discussed further below.

Figure 2:
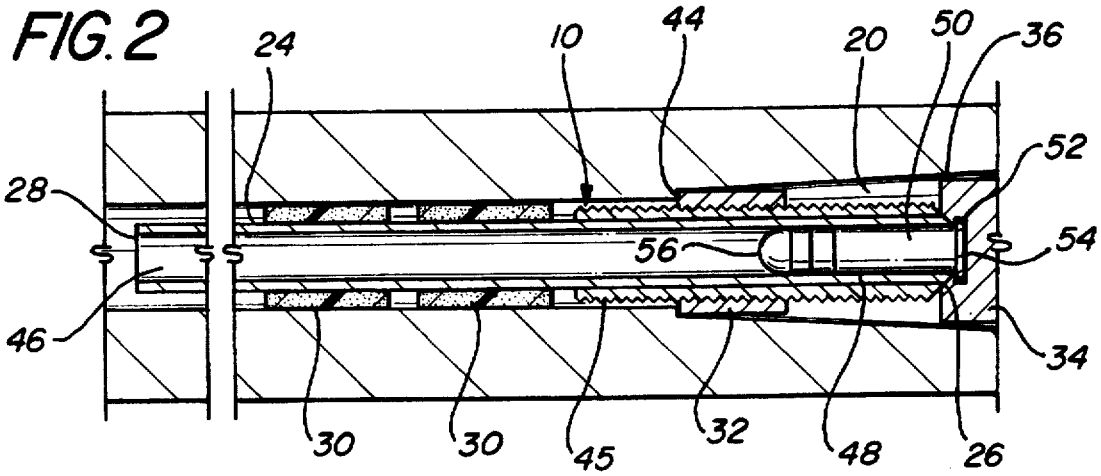
FIG. 2 is an enlarged cross-sectional view of a portion of the adapter device shown in FIG. 1.

Referring now to FIG. 2, this view more clearly shows certain details of adapter device 10. Each of spacer rings 30 has an interior surface that is fixedly secured to the exterior surface of adapter barrel 24. A presently preferred adhesive for securing spacer rings 30 to adapter barrel 24 is a general purpose adhesive which is pressure sensitive, permanent, and dispensed as an aerosol (available from Keyston Brothers of Walnut Creek, Calif.).

Chamber 20 has a forward shoulder 44 which is abutted by the forward end of adjustment nut 32. It should be apparent that adjusting the position of adjustment nut 32 along adapter barrel 24 will change the distance between the forward end of adjustment nut 32 and rear carrier end 38 (FIG. 1A), thus allowing adjustment of adapter device 10 to fit a primary chamber of another firearm having a different length than that shown. Adjustment nut 32 has internal threads which engage external threads of a sleeve 45. Sleeve 45 has an interior surface that is fixedly secured by any suitable means, such as a cement or adhesive, to the exterior surface of adapter barrel 24.

Adapter barrel 24 has an adapter bore 46 and adapter chamber 48 defined therein such that adapter bore 46 extends from adapter muzzle 28 to adapter chamber 48 and adapter chamber 48 extends to adapter breech 26. Adapter chamber 48 is shown as receiving a cartridge 50 therein which is ready for firing. Adapter chamber 48 is typically a few thousandths of an inch larger in diameter than bore 46 if cartridge 50 is a 0.22 caliber cartridge. Adapter bore 46 is preferably rifled in a conventional manner.

Cartridge 50 has a rim 52, a substantially coextensive rear face 54, and a forward end 56 (defined by a bullet). Cartridge 50 is preferably a rimfire 0.22 caliber cartridge. However, other types of cartridges of a smaller caliber than the original caliber of the firearm are within the scope of the invention.

Figure 3:
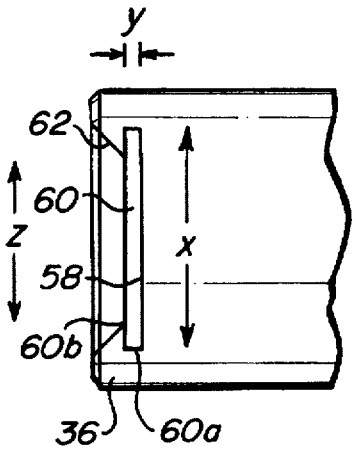
FIG. 3 is a plan view of the forward end of one component of the adapter device, the cartridge carrier. The cartridge carrier is shown in FIG. 3, as well as subsequently described FIGS. 4–6, removed from the firearm.

Referring now to FIG. 2 in conjunction with FIG. 3, forward carrier end 36 defines a forward carrier face 58 and securely holds cartridge 50 by its rim 52 in a slot 60 so that rear face 54 contacts forward carrier face 58. Preferably, rear face 54 is substantially flush with forward carrier face 58 in order to optimize accuracy. Forward carrier end 36 also has a beveled edge 62 immediately adjacent to slot 60. Beveled edge 62 matingly abuts the similarly beveled adapter breech 26 to position cartridge carrier 34, cartridge 50, and adapter barrel 24 in a substantially coaxial relationship, and such that cartridge 50 extends into adapter chamber 48 from its rim 52 to its forward end 56. The latter feature further optimizes accuracy for reasons previously discussed.

Also shown in FIG. 3 are dimensions x, y, and z relating to slot 60. Dimension x is transversely measured between opposing sides of outer boundary **60*a* of slot 60. Dimension y is the depth of slot 60 as longitudinally measured from front to back. Dimension z is transversely measured between opposing sides of inner boundary 60*b* of slot 60. If forward carrier end 36 is intended to hold a standard 0.22 caliber cartridge having a rim with an outer boundary diameter of 0.272 inch, a rim thickness of 0.038 inch, and a case diameter of 0.224 inch, dimension x is preferably 0.275–0.278 inch, dimension y is preferably 0.040–0.043 inch, and dimension z is preferably 0.227–0.234 inch. Generally, whatever caliber of cartridge is being held by forward carrier end 36, dimensions x, y, and z are such that the rim of the cartridge is freely and transversely slidable in slot 60. However, the fit of the rim within slot 60 should preferably orient the rear face of the cartridge to be substantially flush with forward carrier face 58**.

Figure 4:
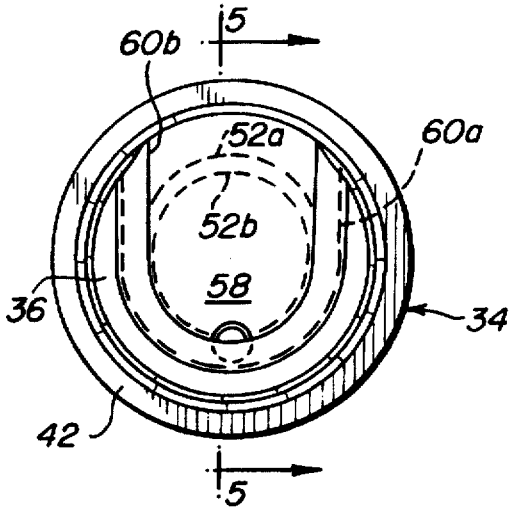
FIG. 4 is an end view of the cartridge carrier showing its forward end.

Referring now to FIG. 4, this end view of cartridge carrier 34 more clearly shows forward carrier end 36 and the substantially "U" shape of outer boundary **60*a* and inner boundary 60*b*. Therefore, slot 60 has an open, upper end which permits easy transverse insertion and removal of rim 52 of the cartridge. Shown in broken lines are outer and inner boundaries 52*a* and 52*b*, respectively, of a cartridge rim as it is positioned when held by forward carrier end 36 in slot 60. Slot 60 securely but removably receives a substantial portion of rim 52. Also visible in FIG. 4 is rim 42** of the rear carrier end.

Figure 5:
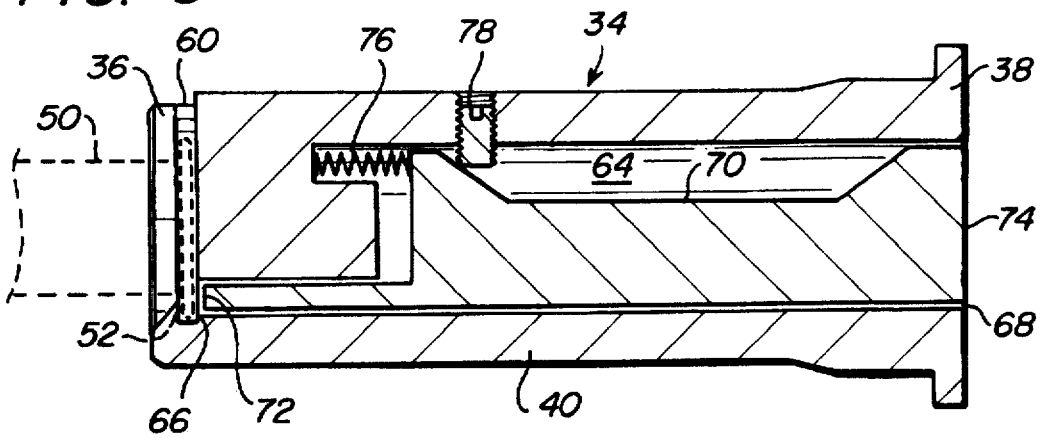
FIG. 5 is a longitudinal cross-sectional view of the cartridge carrier as viewed along line 5—5 in FIG. 4.

Referring now to FIG. 5, this cross-sectional view of cartridge carrier 34 shows internal details of the cartridge carrier. FIG. 5 shows in broken lines the position of cartridge 50 and its rim 52 as held by forward carrier end 36. Carrier body 40 has a passageway 64 longitudinally extending therethrough between forward carrier end 36 and rear carrier end 38. Passageway 64 has a forward open end 66 at forward carrier end 36 and a rear open end 68 at rear carrier end 38. An adapter firing pin 70 extends through passageway 64 and has a forward pin end 72 at or closely adjacent to forward open end 66 and a rear pin end 74 at or closely adjacent to rear open end 68. Forward open end 66 and forward pin end 72 are further shown as being positioned closely adjacent to rim 52 as held in slot 60. Adapter firing pin 70 is mounted within passageway 64 so as to be longitudinally movable in a substantially forward direction, toward forward carrier end 36, in response to striking of rear pin end 74 by the primary firing pin (22 in FIG. 1A), whereby rim 52 is struck by forward pin end 72. Although the embodiment of FIG. 5 assumes cartridge 50 to be a rimfire cartridge, the positions of forward open end 66 and forward pin end 72 could be modified according to an alternative embodiment to fire a centerfire cartridge, in which case the rear face of the cartridge would be struck by the forward pin end.

Cartridge carrier 34 further has a return spring 76 and an adjustable stop 78. Return spring 76 is positioned in passageway 64 to bias adapter firing pin 70 in a substantially rearward direction, toward rear carrier end 38. Therefore, return spring 76 functions to return adapter firing pin 70 to its original position (shown in FIG. 5) after firing. Adjustable stop 78 limits the rearward longitudinal movement of adapter firing pin 70 in passageway 64. In the illustrated embodiment, adjustable stop 78 is threadedly received through an opening in the wall of carrier body 40. Accordingly, adjustable stop 78 can be screwed inwardly or outwardly to stop the rearward movement of adapter firing pin 70 at a desired point.

It should be clearly apparent from FIG. 5 that rim 52 of cartridge 50 can be transversely inserted into or removed from slot 60 without requiring removal of adapter firing pin 70. This makes reloading cartridge carrier 34 easy, convenient, and fast.

Figure 6:
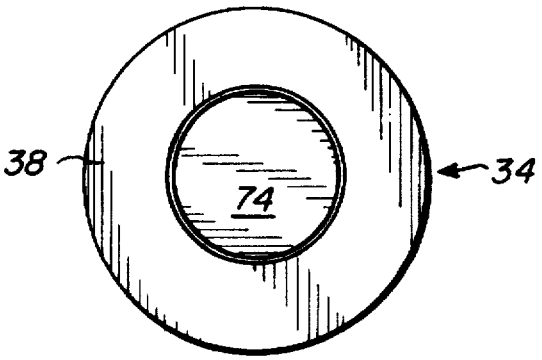
FIG. 6 is an end view of the cartridge carrier showing its rear end.

Referring now to FIG. 6, this end view of cartridge carrier 34 shows rear carrier end 38 and rear pin end 74. Although this view indicates a generally cylindrical shape for the adapter firing pin, it could be shaped differently if desired. FIG. 6, as well as FIG. 4, also indicate a generally cylindrical shape for cartridge carrier 34, which is preferable to conform to the typically cylindrical shape of the primary chamber of the firearm.

Except for spacer rings 30, the components of adapter device 10 are preferably of a metallic construction. Carrier body 40 and respective forward and rear carrier ends 36 and 38 are preferably comprised of a high carbon content, heat treated steel. Adapter firing pin 70 is preferably comprised of any suitably fatigue-proof steel. Adapter barrel 24, adjustment nut 32, and sleeve 45 are preferably comprised of brass or a mild steel.

Adapter device 10 is installed into primary barrel 12 as follows. The installer must first determine if the breech action of the firearm permits insertion of adapter barrel 24 through primary breech 14. If so, adjustment nut 32 is screwed onto adapter barrel 24 by means of externally threaded sleeve 45. Adjustment nut 32 is positioned so that, when adapter breech 26 is in abutment with forward carrier end 36, the distance from the forward end of adjustment nut 32 to rear carrier end 38 is equivalent to the length of primary chamber 20. The length of primary chamber 20 will normally be known for a particular firearm.

Adapter barrel 24 can now be inserted through primary breech 14 and into primary barrel 12. The spacer ring 30 closest to adapter muzzle 28 is squeezed by the installer to reduce its outside diameter sufficiently to allow its insertion into primary bore 18. Adapter barrel 24 is inserted through primary breech 14 so that the above-mentioned spacer ring 30 is in primary bore 18. Such spacer ring 30 will then expand in a radially uniform manner so that the exterior surface of the spacer ring is in flush contact with the interior surface of primary barrel 12, and adapter muzzle 28 is centered within primary bore 18. Each of the other spacer rings 30 is similarly manipulated and adapter barrel 24 gradually inserted into primary barrel 12 until adjustment nut 32 abuts forward shoulder 44. Upon the final few inches of insertion, when adapter breech 26 is inserted into primary chamber 20, this can be done with one's finger or with a push rod having a non-marring tip (i.e. plastic or brass).

If the breech action of the firearm prevents the above-described insertion of adapter barrel 24 through primary breech 14, then adapter barrel 24 must be inserted into primary barrel 12 through primary muzzle 16 with adjustment nut 32 removed. A push rod is used to push adapter barrel 24 completely through primary barrel 12 and through primary breech 14 a sufficient extent to allow screwing of adjustment nut 32 onto adapter barrel 24 by means of sleeve 45. The rear portion of adapter barrel 24 extending from primary breech 14 is then pushed back into primary barrel 12 so that adjustment nut 32 abuts forward shoulder 44.

Prior to or after insertion of adapter barrel 24 into primary barrel 12, cartridge 50 is transversely inserted onto forward carrier end 36 with rim 52 in slot 60. Cartridge carrier 34, with cartridge 50 thereon, is then inserted into primary chamber 20 so that cartridge 50 extends into adapter chamber 48 and forward carrier end 36 abuts adapter breech 26. The firearm is now ready to fire cartridge 50.

Upon firing, when primary firing pin 22 strikes adapter firing pin 70, the case of cartridge 50 expands instantaneously and seals against the interior surface of adapter barrel 24 at adapter breech 26. This assists in preventing the leakage of combustion gases to the rear. After firing, the case of cartridge 50 will relax back to its approximate original diameter so as to be easily removable from adapter chamber 48.

After firing of cartridge 50, cartridge carrier 34 is extracted from primary chamber 20 in a conventional manner by an extractor (not shown), which engages rim 42 of rear carrier end 38. The fired cartridge is removed from cartridge carrier 34, and can be reloaded with a new cartridge. To remove adapter device 10 from primary barrel 12, a push rod can be inserted through primary muzzle 16 to push adapter barrel 24 through primary barrel 12 at least a sufficient extent to allow adapter barrel 24 to be grasped adjacent to adapter breech 26, and then pulled completely out of primary barrel 12.

Figure 7:
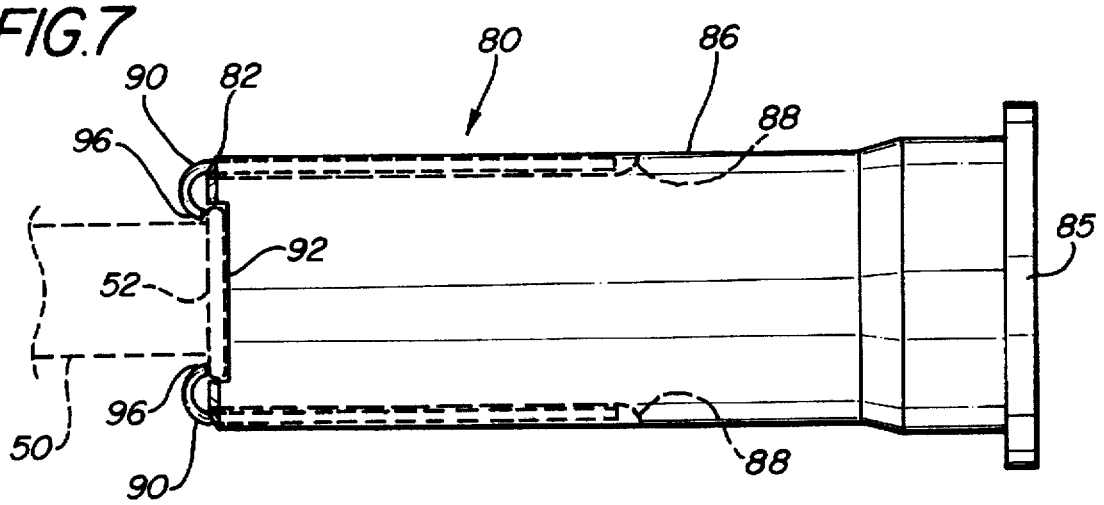
FIG. 7 is a side view of a cartridge carrier according to another embodiment.

Referring now to FIG. 7, a cartridge carrier 80 is shown in accordance with another embodiment. Cartridge carrier 80 is similar to the previously described cartridge carrier 34, except for the means by which the cartridge is held by its rim. Cartridge carrier 80 has a forward carrier end 82, a rear carrier end 84, and a carrier body 86 extending between forward carrier end 82 and rear carrier end 84. Carrier body 86 has a pair of longitudinally extending, radially opposite grooves 88 in which a corresponding pair of retainer clips 90 are securely mounted. Retainer clips 90 are preferably comprised of a high carbon content, heat treated steel, and are preferably mounted in grooves 88 by being peened into place. Forward carrier end 82 has a recessed face portion 92 for receiving rim 52 of cartridge 50, as is shown in broken lines. Each of retainer clips 90 has a forward clip end 96 positioned closely adjacent to recessed face portion 92 such that rim 52 can be securely but removably received between forward clip ends 96 and recessed face portion 92.

Figure 8:
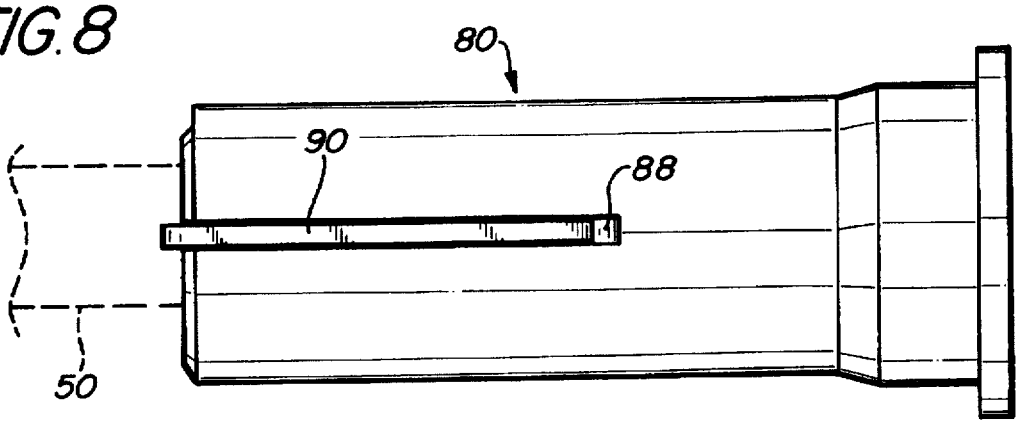
FIG. 8 is a view of the cartridge carrier of FIG. 7 rotated 90° about its longitudinal axis to more clearly show certain details.

Referring now to FIG. 8, this view of cartridge carrier 80, rotated 90° from the view of FIG. 7, shows one of retainer clips 90 and its corresponding groove 88.

Figure 9:
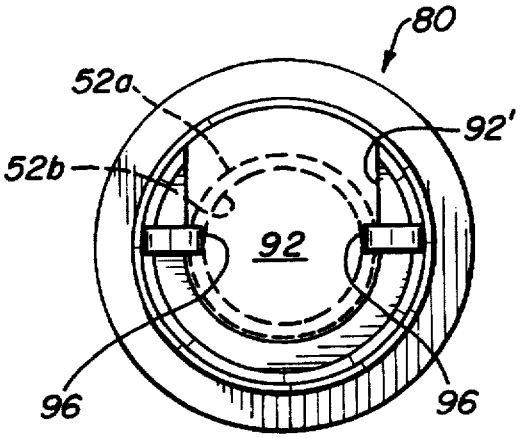
FIG. 9 is an end view of the cartridge carrier of FIGS. 7 and 8 which shows its forward end.

Referring now to FIG. 9, this end view of cartridge carrier 80 shows recessed face portion 92 as having a boundary 92' with a substantially "U" shape. The position of rim 52, as held between forward clip ends 96 and recessed face portion 92, is indicated in broken lines by its outer boundary **52*a* and inner boundary 52*b*. Rim 52 can be transversely inserted into or removed from the position shown in a similar manner to that described with reference to cartridge carrier 34**.

Obviously, many modifications and variations of the present invention are possible in light of the above teachings. For example, the adapter device of the invention could be adapted for use in a breech-loading pistol. Or, the adapter device could even be adapted for use in a breech-loading shotgun to effectively convert it to a rifle. It is, therefore, to be understood that within the scope of the appended claims, the invention can be practiced otherwise than as specifically described.

That which is claimed is:

1. An adapter device for use in a firearm to fire a cartridge having a rim and a substantially coextensive rear face, wherein the firearm is of the breech-loading type including a primary barrel, a primary breech, a primary muzzle, and a primary bore and primary chamber defined therein such that the primary bore extends from the primary muzzle to the primary chamber and the primary chamber extends to the primary breech, the firearm further including a primary firing pin to the rear of the primary breech, wherein the adapter device comprises:

an adapter barrel having an adapter breech which is beveled, an adapter muzzle, and an adapter bore and adapter chamber defined therein such that the adapter bore extends from the adapter muzzle to the adapter chamber and the adapter chamber extends to the adapter breech, wherein the adapter barrel is sized for being received within the primary barrel;

a spacer means, fixedly secured to the adapter barrel, for being disposed in the primary barrel to support the adapter barrel within the primary barrel in substantially coaxial relationship therewith, and such that the adapter barrel extends through at least a portion of the primary barrel from the adapter breech, closely adjacent to or within the primary chamber, to the adapter muzzle; and a cartridge carrier sized and shaped to fit within the primary chamber and having (i) a forward carrier end defining a forward carrier face and being adapted to removably hold the cartridge by its rim so that the rear face of the cartridge contacts the forward carrier face, the forward carrier end having a beveled edge and being further adapted to matingly abut the adapter breech in such a manner that the cartridge extends into the adapter chamber and such that the cartridge carrier, cartridge, and adapter barrel are in a substantially coaxial relationship, (ii) a rear carrier end for being positioned at or closely adjacent to the primary breech, (iii) a carrier body extending between the forward and rear carrier ends and having a passageway longitudinally extending therethrough between the forward and rear carrier ends, the passageway having a forward open end at the forward carrier end and a rear open end at the rear carrier end, and (iv) an adapter firing pin extending through the passageway and having a forward pin end at or closely adjacent to the forward open end and a rear pin end at or closely adjacent to the rear open end, the adapter firing pin being mounted within the passageway so as to be longitudinally movable in a substantially forward direction in response to striking of the rear pin end by the primary firing pin, whereby the rim or rear face of the cartridge as held by the forward carrier end is struck by the forward pin end.

2. An adapter device as recited in claim 1 wherein the cartridge has a forward end, and wherein the forward carrier end is adapted to hold the cartridge such that the cartridge extends into the adapter chamber from its rim to its forward end.

3. An adapter device as recited in claim 2 wherein the forward carrier end is adapted to hold the cartridge to allow removal of the cartridge, when the cartridge carrier is removed from the primary chamber, without requiring removal of the adapter firing pin.

4. An adapter device as recited in claim 3 wherein the forward carrier end is adapted to hold the cartridge with its rear face substantially flush with the forward carrier face.

5. An adapter device as recited in claim 4 wherein the forward carrier end has a slot for securely but removably receiving a substantial portion of the rim of the cartridge therein.

6. An adapter device as recited in claim 4 wherein the forward open end and forward pin end are positioned closely adjacent to the rim of the cartridge as held by the forward carrier end, whereby upon longitudinal forward movement of the adapter firing pin the forward pin end strikes the rim of the cartridge.

7. An adapter device as recited in claim 6 wherein the spacer means comprises a plurality of rings, each ring being comprised of a resilient and compressible foam material.

8. An adapter device as recited in claim 7 wherein the resilient foam material is polyurethane foam.

9. An adapter device as recited in claim 8 wherein the primary chamber has a forward shoulder, and wherein the adapter device further comprises an adjustment nut threadedly and removably received on the adapter barrel to allow adjustment of its position along at least a portion of the adapter barrel, the adjustment nut being sized and shaped to abut the forward shoulder, whereby adjustability of the position of the adjustment nut on the adapter barrel enables adjustment of the device to fit the length of the primary chamber.

10. A cartridge carrier for use in a firearm with a cartridge having a rim and a substantially coextensive face, comprising:

a first carrier end defining a carrier face and having a slot for securely but removably receiving a substantial portion of the rim of the cartridge so that the face of the cartridge contacts the carrier face;

a second carrier end opposite the first carrier end;

a carrier body extending between the first and second carrier ends and having a passageway longitudinally extending between the first and second carrier ends, the passageway having a first open end at the first carrier end and a second open end at the second carrier end;

a firing pin extending through the passageway and having a first pin end at or closely adjacent to the first open end and a second pin end at or closely adjacent to the second open end, the firing pin being mounted within the passageway so as to be longitudinally movable in a direction substantially toward the first carrier end in response to an impact upon the second pin end, whereby the rim or face of the cartridge as held by the first carrier end is struck by the first pin end.

11. A cartridge carrier as recited in claim 10 wherein the first carrier end is adapted to hold the cartridge in a substantially coaxial relationship with the cartridge carrier.

12. A cartridge carrier as recited in claim 11 wherein the first carrier end is adapted to hold the cartridge to allow removal of the cartridge without requiring removal of the firing pin.

13. An adapter device as recited in claim 12 wherein the first carrier end is adapted to hold the cartridge with its face substantially flush with the carrier face.

14. A cartridge carrier as recited in claim 13 wherein the first open end and first pin end are positioned closely adjacent to the rim of the cartridge as held by the first carrier end, whereby upon longitudinal movement of the firing pin toward the first carrier end, the first pin end strikes the rim of the cartridge.

15. An adapter device for use in a firearm to fire a cartridge having a rim and a substantially coextensive rear face, wherein the firearm is of the breech-loading type including a primary barrel, a primary breech, a primary muzzle, and a primary bore and primary chamber defined therein such that the primary bore extends from the primary muzzle to the primary chamber and the primary chamber extends to the primary breech, the firearm further including a primary firing pin to the rear of the primary breech, wherein the adapter device comprises:

an adapter barrel having an adapter breech, an adapter muzzle, and an adapter bore and adapter chamber defined therein such that the adapter bore extends from the adapter muzzle to the adapter chamber and the adapter chamber extends to the adapter breech, wherein the adapter barrel is sized for being received within the primary barrel;

a spacer means, fixedly secured to the adapter barrel, for being disposed in the primary barrel to support the adapter barrel within the primary barrel in substantially coaxial relationship therewith, and such that the adapter barrel extends through at least a portion of the primary barrel from the adapter breech, closely adjacent to or within the primary chamber, to the adapter muzzle; and a cartridge carrier sized and shaped to fit within the primary chamber and having (i) a forward carrier end defining a forward carrier face which has a recessed face portion for receiving the rim of the cartridge so that the rear face of the cartridge contacts the recessed face portion, the forward carrier end being further adapted to abut the adapter breech in such a manner that the cartridge extends into the adapter chamber, (ii) at least two opposing retaining clips having respective forward clip ends positioned closely adjacent to the recessed face portion such that the rim of the cartridge can be securely but removably received between the forward clip ends and the recessed face portion, (iii) a rear carrier end for being positioned at or closely adjacent to the primary breech, (iv) a carrier body extending between the forward and rear carrier ends and having a passageway longitudinally extending therethrough between the forward and rear carrier ends, the passageway having a forward open end at the forward carrier end and a rear open end at the rear carrier end, and (v) an adapter firing pin extending through the passageway and having a forward pin end at or closely adjacent to the forward open end and a rear pin end at or closely adjacent to the rear open end, the adapter firing pin being mounted within the passageway so as to be longitudinally movable in a substantially forward direction in response to striking of the rear pin end by the primary firing pin, whereby the rim or rear face of the cartridge as held by the forward carrier end is struck by the forward pin end.

16. An adapter device for use in a firearm to fire a cartridge having a rim and a substantially coextensive rear face, wherein the firearm is of the breech-loading type including a primary barrel, a primary breech, a primary muzzle, and a primary bore and primary chamber defined therein such that the primary bore extends from the primary muzzle to the primary chamber and the primary chamber extends to the primary breech, the firearm further including a primary firing pin to the rear of the primary breech, wherein the adapter device comprises:

an adapter barrel having an adapter breech, an adapter muzzle, and an adapter bore and adapter chamber defined therein such that the adapter bore extends from the adapter muzzle to the adapter chamber and the adapter chamber extends to the adapter breech, wherein the adapter barrel is sized for being received within the primary barrel;

a spacer means, fixedly secured to the adapter barrel, for being disposed in the primary barrel to support the adapter barrel within the primary barrel in substantially coaxial relationship therewith, and such that the adapter barrel extends through at least a portion of the primary barrel from the adapter breech, closely adjacent to or within the primary chamber, to the adapter muzzle; and a cartridge carrier sized and shaped to fit within the primary chamber and having (i) a forward carrier end defining a forward carrier face and being adapted to removably hold the cartridge by its rim so that the rear face of the cartridge contacts the forward carrier face, the forward carrier end being further adapted to abut the adapter breech in such a manner that the cartridge extends into the adapter chamber, (ii) a rear carrier end for being positioned at or closely adjacent to the primary breech, (iii) a carrier body extending between the forward and rear carrier ends and having a passageway longitudinally extending therethrough between the forward and rear carrier ends, the passageway having a forward open end at the forward carrier end and a rear open end at the rear carrier end, (iv) an adapter firing pin extending through the passageway and having a forward pin end at or closely adjacent to the forward open end and a rear pin end at or closely adjacent to the rear open end, the adapter firing pin being mounted within the passageway so as to be longitudinally movable in a substantially forward direction in response to striking of the rear pin end by the primary firing pin, whereby the rim or rear face of the cartridge as held by the forward carrier end is struck by the forward pin end; (v) a return spring positioned in the passageway to bias the adapter firing pin in a rearward direction, and (vi) an adjustable stop for limiting the rearward longitudinal movement of the adapter firing pin in the passageway.

17. A cartridge carrier for use in a firearm with a cartridge having a rim and a substantially coextensive face, comprising:

a first carrier end defining a carrier face which has a recessed face portion for receiving the rim of the cartridge so that the face of the cartridge contacts the recessed face portion;

a second carrier end opposite the first carrier end;

at least two opposing retainer clips having respective clip ends positioned closely adjacent to the recessed face portion such that the rim of the cartridge can be securely but removably received between the clip ends and the recessed face portion;

a carrier body extending between the first and second carrier ends and having a passageway longitudinally extending between the first and second carrier ends, the passageway having a first open end at the first carrier end and a second open end at the second carrier end;

a firing pin extending through the passageway and having a first pin end at or closely adjacent to the first open end and a second pin end at or closely adjacent to the second open end, the firing pin being mounted within the passageway so as to be longitudinally movable in a direction substantially toward the first carrier end in response to an impact upon the second pin end, whereby the rim or face of the cartridge as held by the first carrier end is struck by the first pin end.

18. A cartridge carrier for use in a firearm with a cartridge having a rim and a substantially coextensive face, comprising:

a first carrier end defining a carrier face and being adapted to removably hold the cartridge by its rim so that the face of the cartridge contacts the carrier face;

a second carrier end opposite the first carrier end;

a carrier body extending between the first and second carrier ends and having a passageway longitudinally extending between the first and second carrier ends, the passageway having a first open end at the first carrier end and a second open end at the second carrier end;

a firing pin extending through the passageway and having a first pin end at or closely adjacent to the first open end and a second pin end at or closely adjacent to the second open end, the firing pin being mounted within the passageway so as to be longitudinally movable in a direction substantially toward the first carrier end in response to an impact upon the second pin end, whereby the rim or face of the cartridge as held by the first carrier end is struck by the first pin end a return spring positioned in the passageway to bias the firing pin in a direction substantially toward the second carrier end; and an adjustable stop for limiting the longitudinal movement of the firing pin toward the second carrier end.

* * * * *